US006059401A

United States Patent [19]

Wu et al.

[11] Patent Number: 6,059,401

[45] **Date of Patent: *May 9, 2000**

[54] ALIGNMENT COUPLING DEVICE FOR MANUALLY CONNECTING AN INK SUPPLY TO AN INKJET PRINT CARTRIDGE

[75] Inventors: Paul S. Wu, Encinitas; Conrad A. Sumera, San Marcos; Andrew R. Robinson, San Diego, all of Calif.

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/045,151

[22] Filed: Mar. 19, 1998

[51] Int. Cl.[7] ..... B41J 2/175

[52] U.S. Cl. ..... 347/85

[58] Field of Search ..... 347/85, 86, 87, 347/64; 137/614.05

[56] References Cited

U.S. PATENT DOCUMENTS

| | | | |
|---|---|---|---|
| 4,831,389 | 5/1989 | Chan | 347/86 |
| 5,280,300 | 1/1994 | Fong et al. | 347/87 |
| 5,367,328 | 11/1994 | Erickson | 347/7 |
| 5,686,947 | 11/1997 | Murray et al. | 347/85 |
| 5,691,754 | 11/1997 | Ta | 347/86 |
| 5,719,610 | 2/1998 | Scheffelin | 347/7 |
| 5,736,992 | 4/1998 | Pawlowski, Jr. | 347/85 |
| 5,745,137 | 4/1998 | Scheffelin et al. | 347/85 |
| 5,751,319 | 5/1998 | Robertson et al. | 347/85 |
| 5,777,648 | 7/1998 | Scheffelin et al. | 347/87 |
| 5,813,339 | 9/1998 | Schmitt et al. | 101/335 |
| 5,852,459 | 12/1998 | Pawlowski, Jr. et al. | 347/86 |
| 5,874,976 | 2/1999 | Katon et al. | 347/85 |

*Primary Examiner*—N. Le
*Assistant Examiner*—Anh T. N. Vo
*Attorney, Agent, or Firm*—David S. Romney

[57] ABSTRACT

A unitary coupler and method is provided for interconnecting an ink supply with an inkjet printhead. The coupler includes a first set of latching surfaces for attaching the coupler to the printhead; a second set of latching surfaces integral with the coupler for locking engagement with an inlet valve from an off-carriage ink supply; and alignment guides at one end for receiving the inlet valve. In a preferred method the coupler is initially attached to the printhead and subsequently attached to the inlet valve from the ink supply.

19 Claims, 11 Drawing Sheets

ALIGNMENT COUPLING DEVICE FOR MANUALLY CONNECTING AN INK SUPPLY TO AN INKJET PRINT CARTRIDGE

CROSS-REFERENCE TO RELATED APPLICATIONS

Other more recent co-pending commonly assigned related applications are U.S. Ser. No. 09/045,148, entitled "Assembly Technique Using Modular Ink Delivery Components For Installation In An Inkjet Printer" filed Mar. 19, 1998 by Erich E. Coiner et al. and Ser. No. 09/045,150, entitled "Ink Replenishment System With An Open-Valve Printhead Fill Port Continuously Connected To An Ink Supply" filed Mar. 19, 1998 by Paul Wu et al., both of which are incorporated by reference herein.

A previously filed co-pending commonly assigned application related to this application is Ser. No. 08/454,975 filed May 31, 1995 by Joseph E. Scheffelin et al. (the "'975 application") entitled CONTINUOUS REFILL OF SPRING BAG RESERVOIR IN AN INK-JET SWATH PRINTER/PLOTTER, now U.S. Pat. No. 5,745,137 which is incorporated herein by reference.

Other more recent co-pending commonly assigned related applications are Ser. No. 08/726,587, now U.S. Pat. No. 5,874,976 entitled INKJET CARTRIDGE FILL PORT ADAPTOR, filed Oct. 7, 1996, by Max S. Gunther, et al.; Ser. No. 08/810,485, entitled INKJET PRINTING WITH REPLACEABLE SET OF INK-RELATED COMPONENTS etc., filed Mar. 3, 1997, by Rick Becker, et al.; Ser. No. 08/805,859, entitled REPLACEABLE INK SUPPLY MODULE (BAG/BOX/TUBE/VALVE) etc., filed Mar. 3, 1997, by Elizabeth Zapata, et al.; Ser. No. 08/805,860, entitled SPACE EFFICIENT ENCLOSURE SHAPE FOR NESTING TOGETHER A PLURALITY OF REPLACEABLE INK SUPPLY BAGS, filed Mar. 3, 1997, by Erich Coiner, et al.; Ser. No. 08/810,840, now U.S. Pat. No. 5,929,883 entitled PRINTING SYSTEM WITH SINGLE ON/OFF CONTROL VALVE etc., filed Mar. 3, 1997 by Max S. Gunther, et al; Ser. No. 09/034,721, entitled INTERCHANGEABLE FLUID INTERCONNECT ATTACHMENT AND INTERFACE, filed Mar. 4, 1998 by Max S. Gunther; all of which are incorporated herein by reference.

FIELD OF THE INVENTION

This invention relates to inkjet printers and, more particularly, to an inkjet print cartridge which can be recharged with ink.

BACKGROUND OF THE INVENTION

A popular type of inkjet printer contains a scanning carriage for supporting one or more disposable print cartridges. Each disposable print cartridge contains a supply of ink in an ink reservoir, a printhead, and ink channels which lead from the ink reservoir to ink ejection chambers formed on the printhead. An ink ejection element, such as a heater resistor or a piezoelectric element, is located within each ink ejection chamber. The ink ejection elements are selectively fired, causing a droplet of ink to be ejected through a nozzle overlying each activated ink ejection chamber so as to print a pattern of dots on the medium. When such printing takes place at 300 dots per inch (dpi) or greater, the individual dots are indistinguishable from one another and high quality characters and images are printed.

Once the initial supply of ink is the ink reservoir is depleted, the print cartridge is disposed of an a new print cartridge is inserted in its place. The printhead, however, has a usable life which outlasts the ink supply. Methods have been proposed to refill these single-use-only print cartridges, but such refilling techniques require penetration into the print cartridge body in a manner not intended by the manufacturer and typically require the user to manually inject the ink into the print cartridge. Additionally, the quality of the refill ink is usually lower than the quality of the original ink. As a result, such refilling frequently results in ink drooling from the nozzles, a messy transfer of ink from the refill kit to the print cartridge reservoir, air pockets forming in the ink channels, poor quality printing resulting from the ink being incompatible with the high speed printing system, and an overall reduction in quality of the printed image.

What is needed is an improved structure and method for recharging the ink supply in an inkjet print cartridge which is not subject to any of the above-mentioned drawbacks of the existing systems.

BRIEF SUMMARY OF THE INVENTION

A new ink delivery system (IDS) for printer/plotters has been developed wherein the on-carriage spring reservoir of the print cartridge is manually and securely connected to the off-carriage reservoir prior to operating the printer.

This invention optimizes the performance of this new off-carriage continuous ink delivery system. In this type of IDS, a pen cartridge that uses an internal spring to provide a vacuum pressure is connected from an inlet port through a unitary coupler to an ink reservoir located off the scanning carriage axis. The coupler serves to align as well as to secure two mating valves to securely hold them together in an open latched position which is not intended to be modified or disconnected until the entire ink supply has been depleted.

A replaceable ink supply module for providing replenishment of an inkjet printhead includes a collapsible bag, an enclosure box, a connective tube, and an on/off valve. These four components are incorporated into a composite sealed system which remains intact during shipment, storage, installation and operation. The collapsible bag is placed inside of the protective enclosure box and has an end-connect outlet permanently attached to one end of the connective tube. The other end of the connective tube carries a permanently attached on/off valve designed for engagement with an inlet valve of an inkjet printhead.

DETAILED DESCRIPTION OF THE PREFERRED EMBODIMENTS

Figure 1:
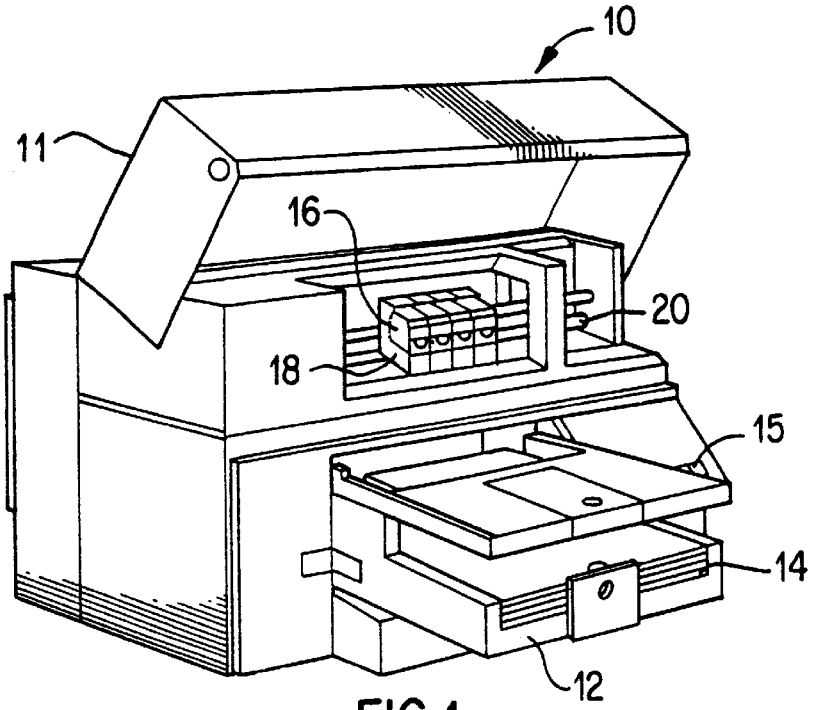
FIG. 1 is a perspective view of an inkjet printer incorporating an embodiment of an inkjet print cartridge.

FIG. 1 illustrates an inkjet printer 10 incorporating the preferred embodiment rechargeable print cartridge. Inkjet printer 10 itself may be conventional. A cover 11 protects the printing mechanism from dust and other foreign objects. A paper input tray 12 supports a stack of paper 14 for printing thereon. The paper, after printing, is then deposited in an output tray 15.

In the embodiment shown in FIG. 1, four print cartridges 16 are mounted in a scanning carriage 18. Print cartridges 16 contain black, cyan, magenta, and yellow ink, respectively. Selective activation of the ink firing elements in each of the four print cartridges 16 can produce a high resolution image in a wide variety of colors. In one embodiment, the black inkjet print cartridge 16 prints at 600 dots per inch (dpi), and the color print cartridges 16 print at 300 dpi.

The scanning carriage 18 is slideably mounted on a rod 20, and carriage 18 is mechanically scanned across the paper, using a well-known belt/wire and pulley system, while print cartridges 16 eject droplets of ink to form printed characters or other images. Since the mechanisms and electronics within printer 10 may be conventional, printer 10 will not be further described in detail.

Figure 2:
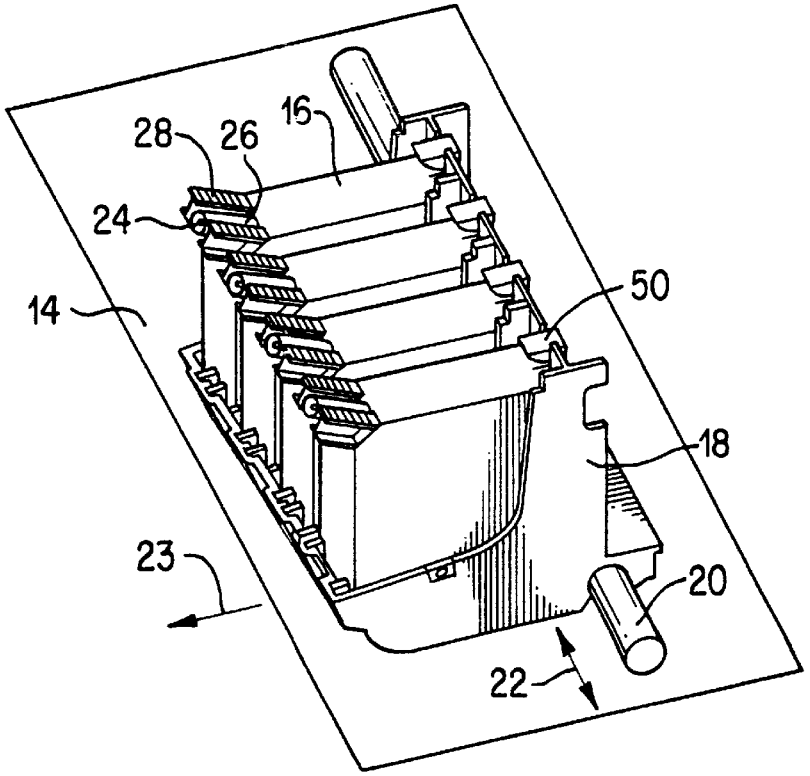
FIG. 2 is a perspective view of a preferred embodiment of a print cartridge being supported by a scanning carriage in the printer of FIG. 1.

FIG. 2 is a more detailed view of the scanning cartridge 18 housing print cartridges 16. Carriage 18 moves in the direction indicated by arrow 22, and a sheet of paper 14 moves in the direction of arrow 23 perpendicular to the direction of movement of carriage 18.

Each print cartridge 16 is removable and engages with fixed electrodes on carriage 18 to provide the electrical signals to the printheads within each of print cartridges 16.

Each of print cartridges 16 contains a valve 24 which may be opened and closed. In an open state, ink from an external ink supply may flow through valve 24 and into the ink reservoir within print cartridge 16. Valve 24 is surrounded by a cylindrical plastic sleeve 26, which generally forms part of a handle 28 for allowing the user to easily grasp print cartridge 16 for insertion into and removal from carriage 18.

Figure 3:
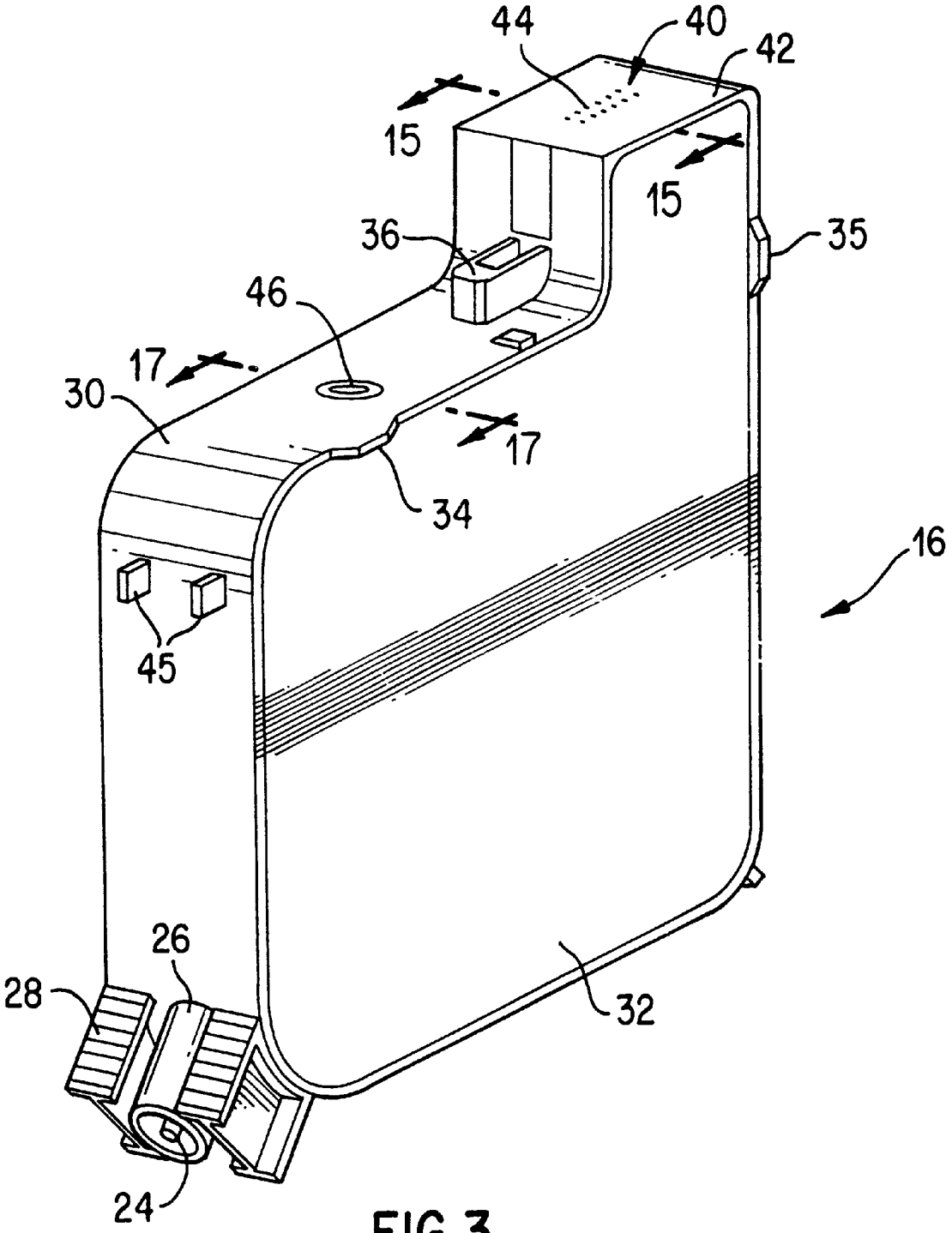
FIG. 3 is a perspective view of a preferred embodiment of a print cartridge incorporating a refill valve.

FIG. 3 shows one perspective view of the preferred embodiment print cartridge 16. Elements labeled with the same numerals in other figures are identical. The outer frame 30 of print cartridge 16 is formed of molded engineering plastic, such as the material marketed under the trademark "NORYL" by General Electric Company. Side covers 32 may be formed of metal or plastic. Datums 34, 35, and 36 affect the position of print cartridge 16 when installed in carriage 18.

In the preferred embodiment, nozzle member 40 consists of a strip of flexible tape 42 having nozzles 44 formed in the tape 42 using laser ablation.

Plastic tabs 45 are used to prevent a particular print cartridge 16 from being inserted into the wrong slot in carriage 18. Tabs 45 are different for the black, cyan, magenta, and yellow print cartridges.

A fill hole 46 is provided for initially filling the ink reservoir in print cartridge 16 by the manufacturer. This hole 46 is later sealed with a steel ball, which is intended to be permanent. Such filling will be described later.

Figure 4:
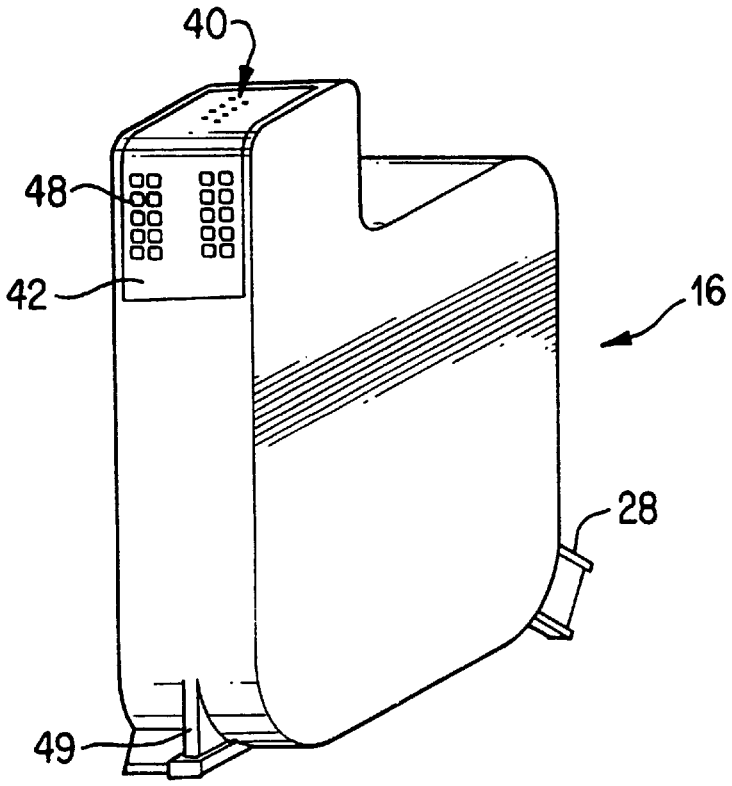
FIG. 4 is a different perspective view of the print cartridge of FIG. 3.

FIG. 4 is another perspective view of print cartridge 16 showing electrical contact pads 48 formed on the flexible tape 42 and connected via traces, formed on the underside of tape 42, to electrodes on the printhead substrate affixed to the underside of tape 42.

A tab 49 engages a spring-loaded lever 50 (FIG. 2) on carriage 18 for locking print cartridges 16 in place in carriage 18.

Figure 5:
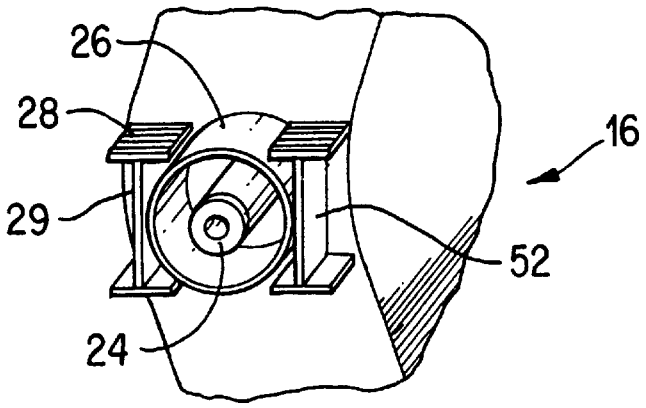
FIG. 5 is a close-up view of one type of refill valve on the print cartridge of FIG. 3.

FIG. 5 is a close-up of the print cartridge valve 24 surrounded by the cylindrical sleeve 26, forming part of handle 28. Support flanges 52 provide added support for handle 28.

A printing system is described in the commonly assigned patent application entitled CONTINUOUS REFILL OF SPRING BAG RESERVOIR IN AN INK-JET SWATH PRINTER/PLOTTER which employs off-carriage ink reservoirs connected to on-carriage print cartridges through flexible tubing. The off-carriage reservoirs continuously replenish the supply of ink in the internal reservoirs of the on-carriage print cartridges, and maintain the back pressure in a range which results in high print quality.

Figure 6:
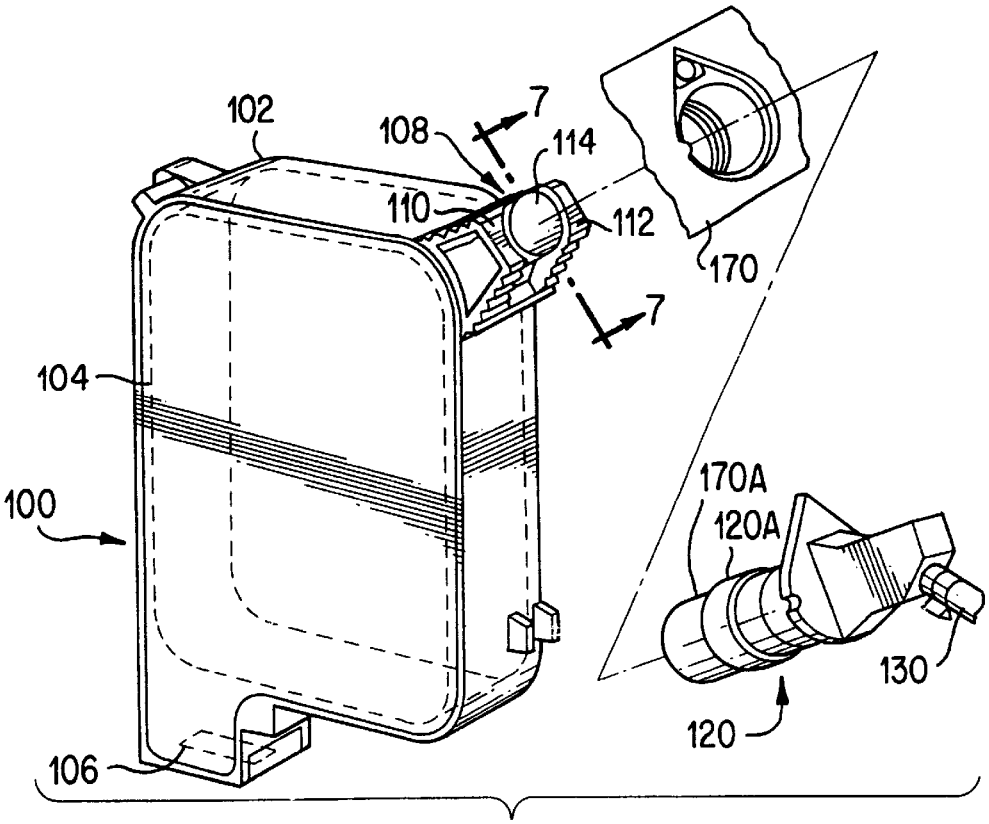
FIG. 6 is an isometric view of an ink-jet print cartridge usable in the system of FIG. 1, with a refill platform housing portion, a needle valve, and supply tube in exploded view.
Figure 7:
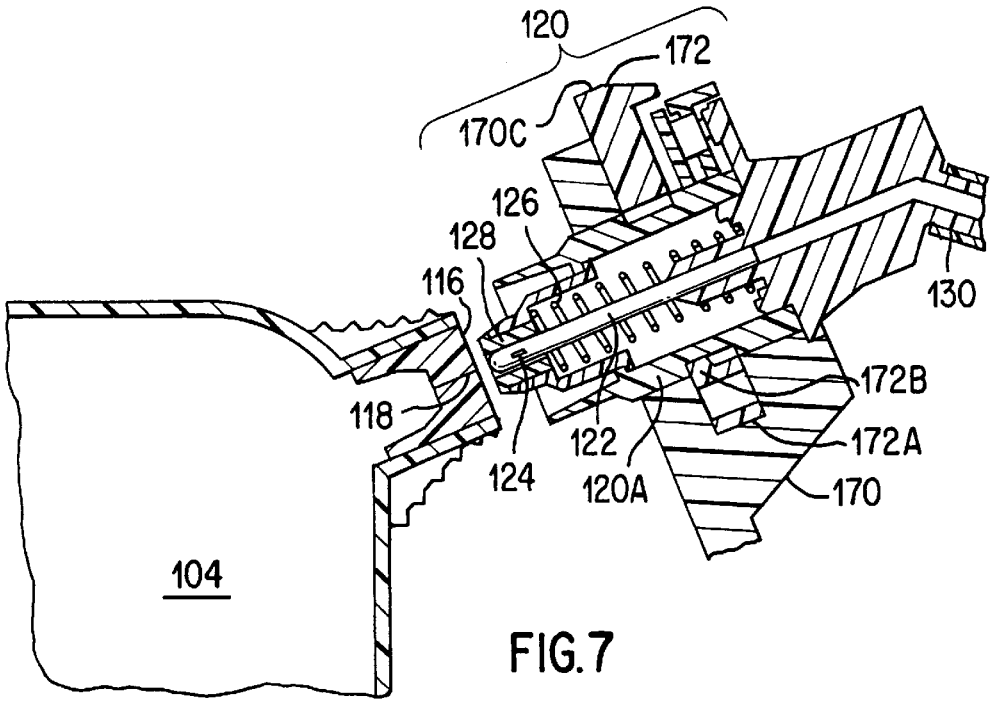
FIG. 7 is a cross-sectional view taken along line 7—7 of FIG. 6, showing the valve structure in a disengaged position relative to a refill port on the print cartridge.
Figure 8:
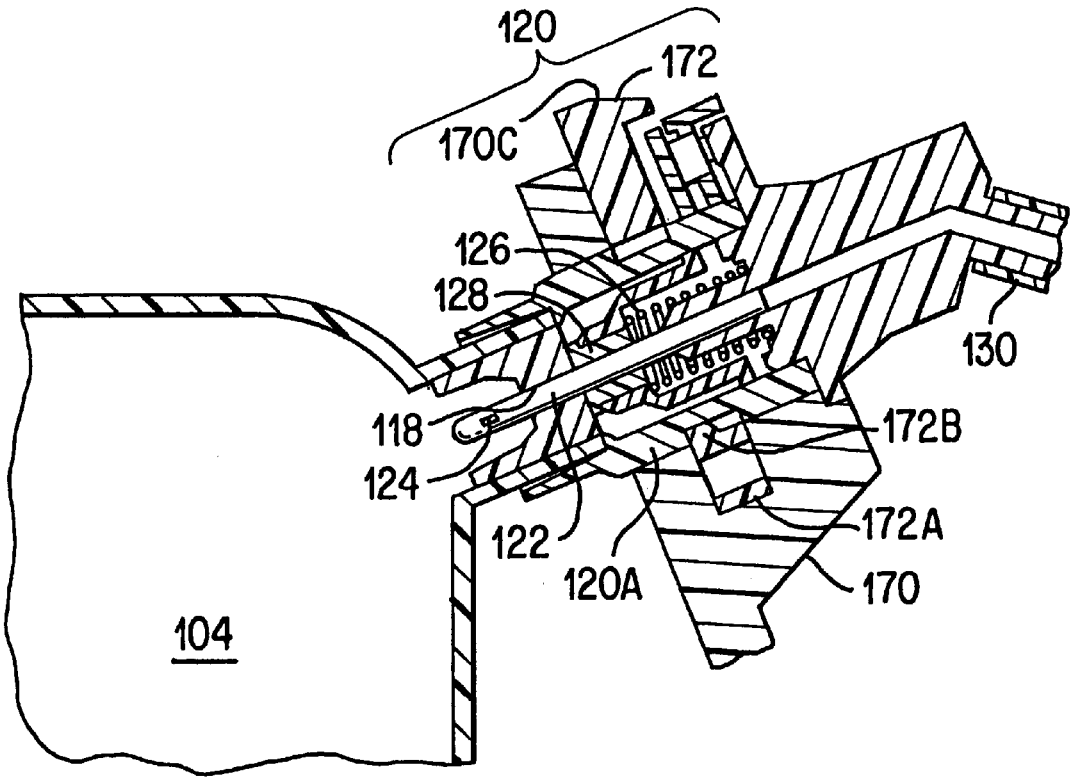
FIG. 8 is a cross-sectional view similar to FIG. 7, but showing the valve structure is an engaged position relative to the refill port of the print cartridge.
Figure 9:
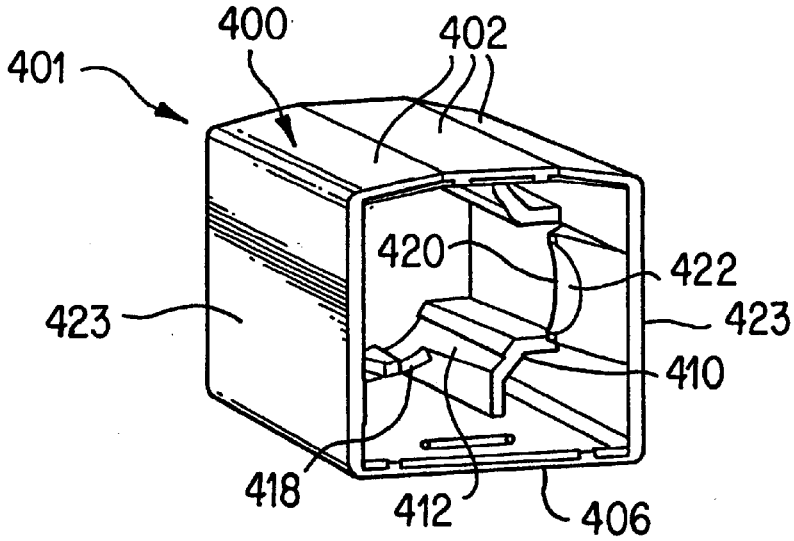
FIG. 9 is a bottom perspective view of a preferred embodiment of an alignment coupler.
Figure 10:
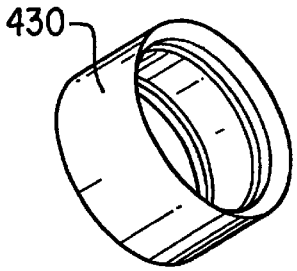
FIG. 10 shows a metal sleeve used on the ink supply valve.
Figure 11:
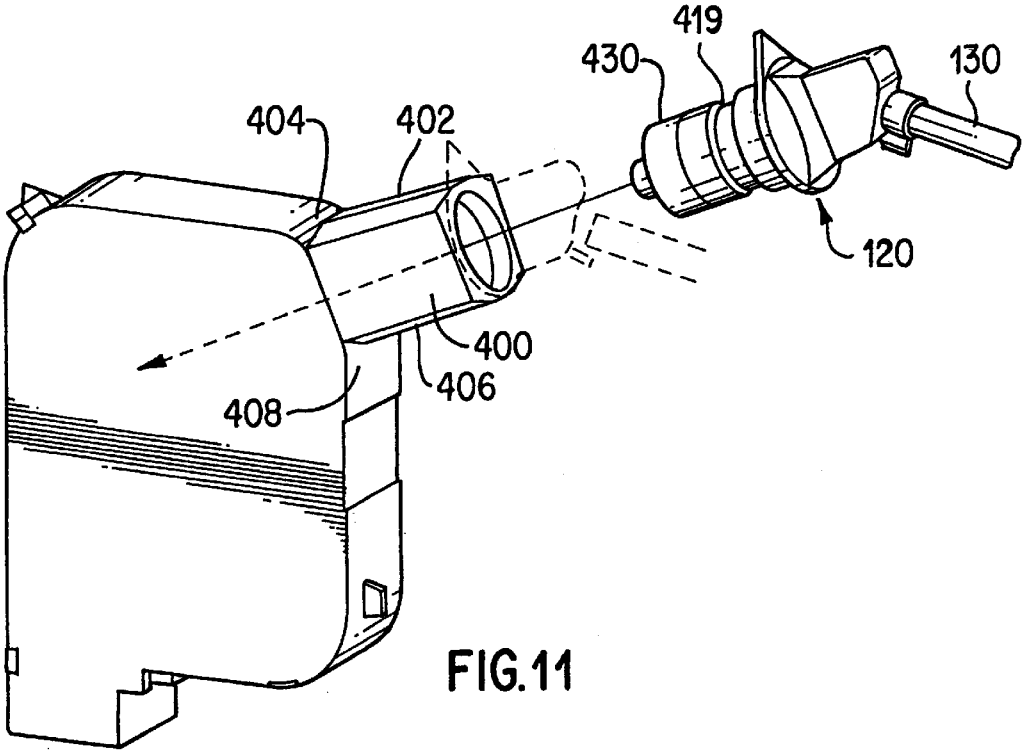
FIG. 11 shows the coupler mounted on a printhead frame, with an ink supply valve ready to be manually inserted to the position shown in phantom lines.
Figure 12:
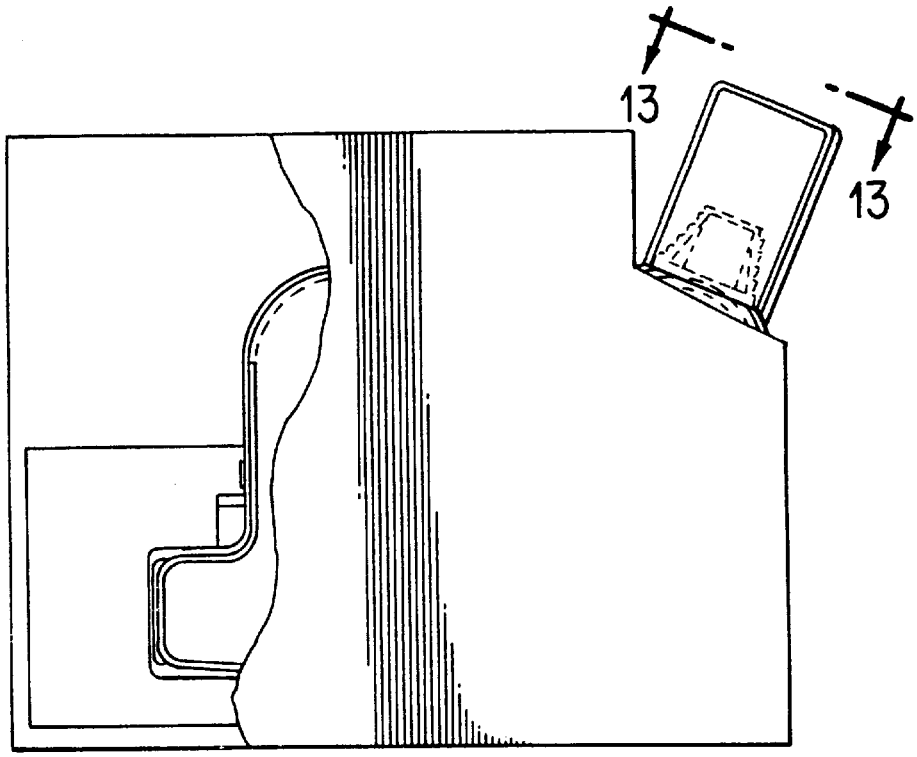
FIG. 12 is a side view of a printhead packaged in its shipping sleeve with the coupler already mounted on the printhead frame.
Figure 13:
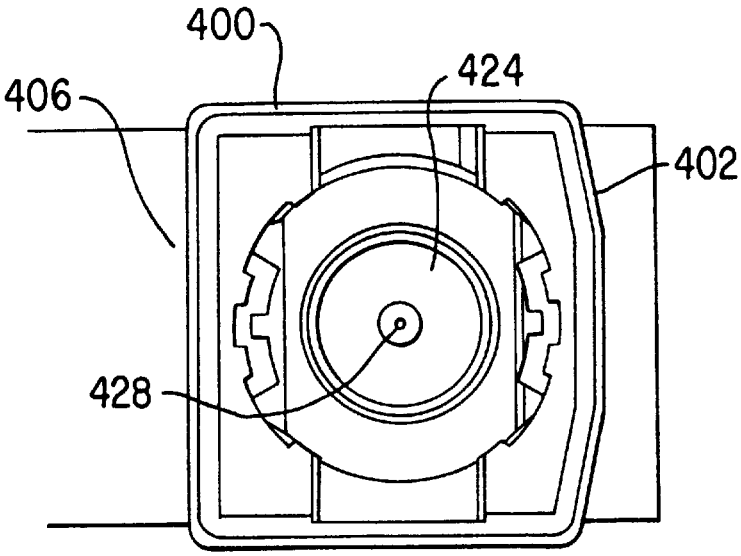
FIG. 13 is a top view taken along the lines 13—13 in FIG. 12.
Figure 14:
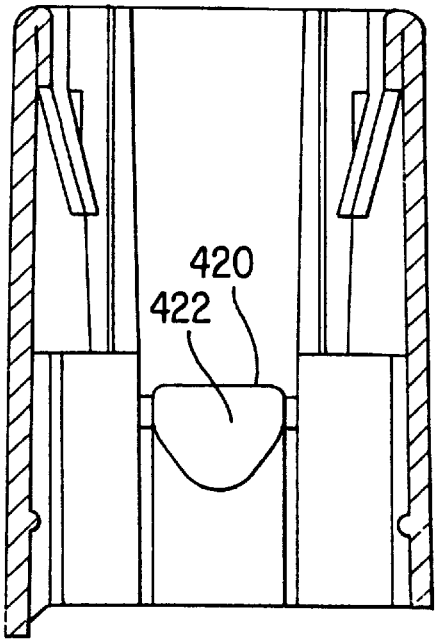
FIG. 14 is a sectional side view of the coupler.
Figure 15:
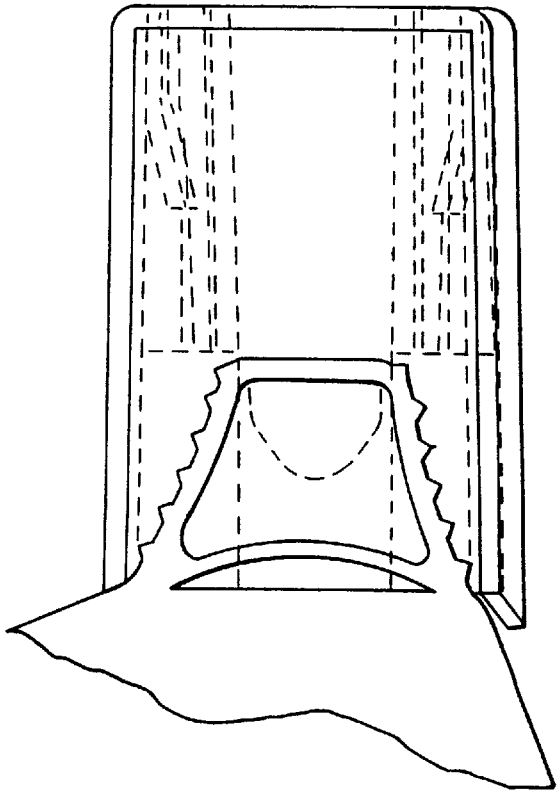
FIG. 15 is a side view of a transparent coupler installed on the printhead frame, showing the gripping handle of the printhead which incorporates the inlet port.
Figure 16:
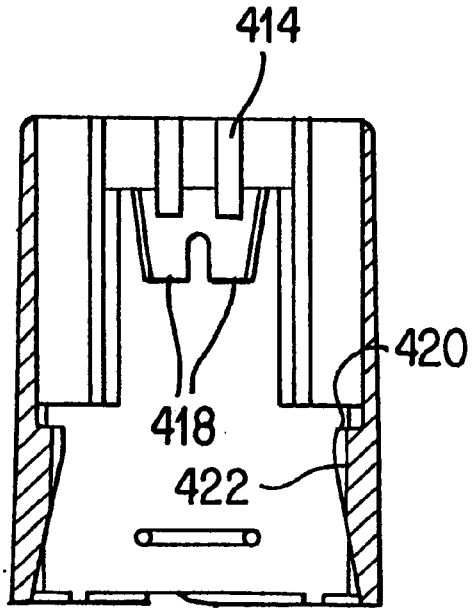
FIG. 16 is a sectional end view of the coupler.
Figure 17:
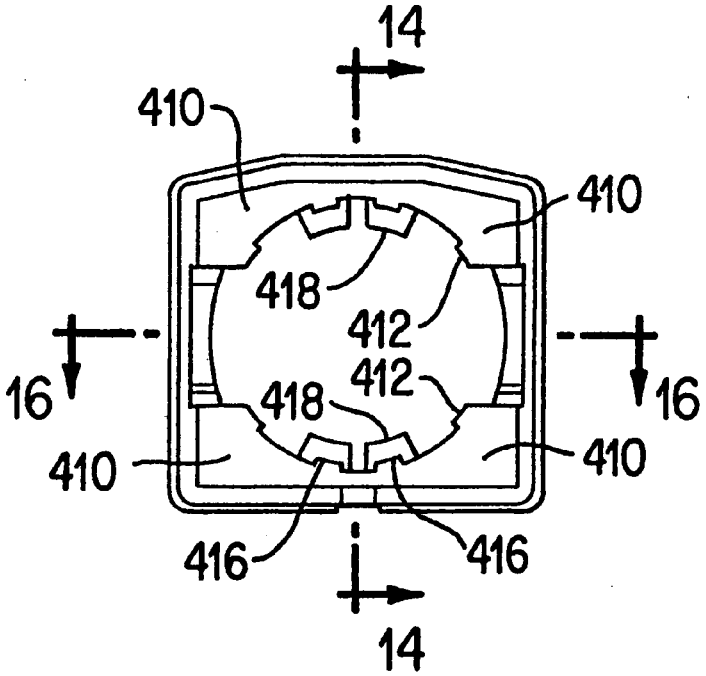
FIG. 17 is a top view of the coupler.
Figure 18:
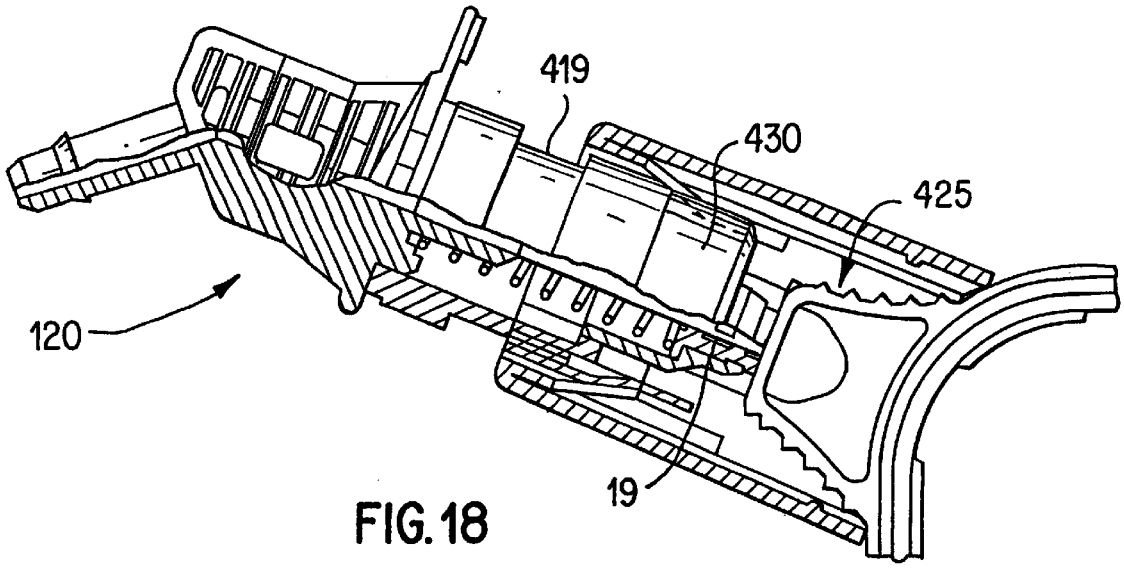
FIG. 18 is a sectional view of the coupler mounted on the printhead frame, showing the ink supply valve partially inserted into the coupler.
Figure 19:
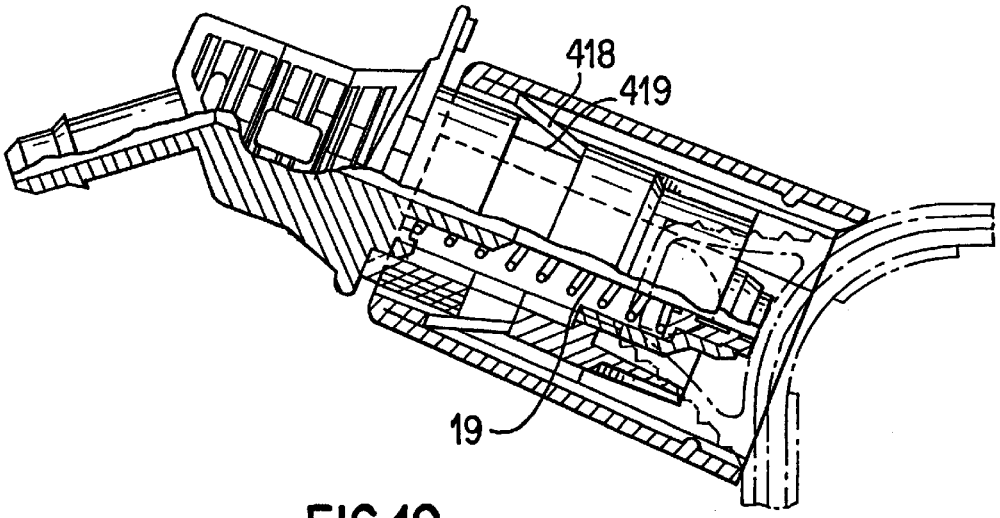
FIG. 19 is a sectional view like FIG. 18 showing the ink supply valve completely inserted into the coupler.
Figure 20:
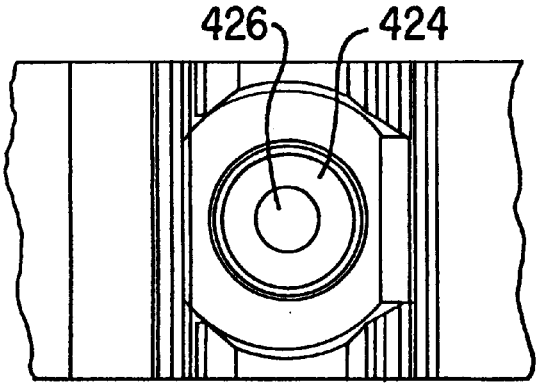
FIG. 20 is a top view of the gripping handle of the printhead showing the septum of the inlet port in closed position.
Figure 21:
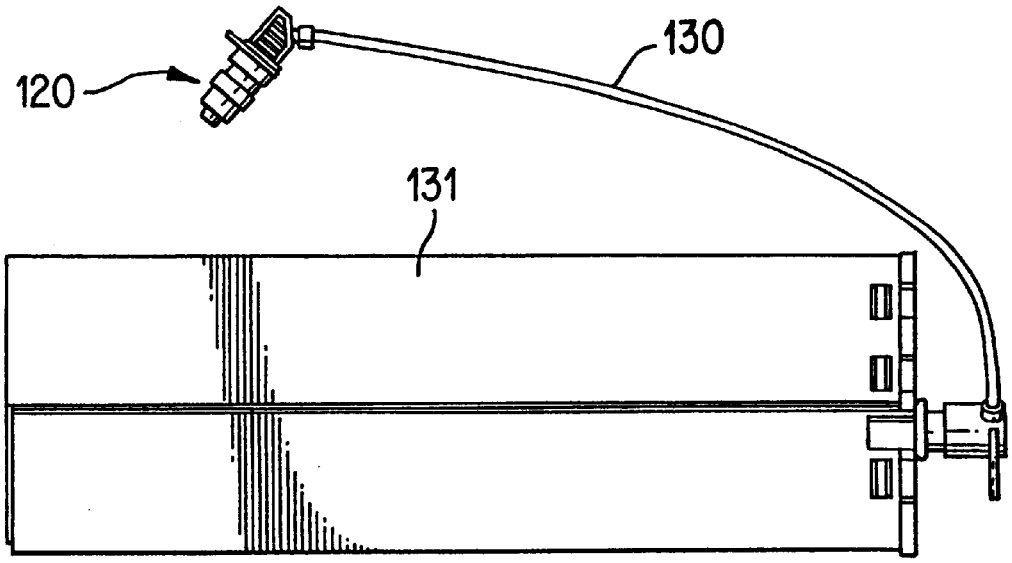
FIG. 21 is a bottom view of a presently preferred off-carriage ink supply module.

The '975 application describes a negative pressure, spring-bag print cartridge which is adapted for continuous refilling. FIGS. 6–8 show an ink-jet print cartridge 100, similar to the cartridges described in the '975 application, but which is adapted for intermittent refilling by addition of a self-sealing refill port in the grip handle of the cartridge. The cartridge 100 illustrates the cartridges 16 of the system of FIG. 1. The cartridge 100 includes a housing 102 which encloses an internal reservoir 104 for storing ink. A printhead 106 with ink-jet nozzles is mounted to the housing. The printhead receives ink from the reservoir 104 and ejects ink droplets while the cartridge scans back and forth along a print carriage during a printing operation. A protruding grip 108 extends from the housing enabling convenient installation and removal from a print carriage within an ink-jet printer. The grip is formed on an external surface of the housing.

FIGS. 6–8 show additional detail of the grip 108. The grip includes two connectors 100, 112 on opposing sides of a cylindrical port 114 which communicates with the reservoir 104. The port is sealed by a septum 116 formed of an elastomeric material. The septum 116 has a small opening 118 formed therein. The grip with its port 114 is designed to intermittently engage with a needle valve structure 120 connected via a tube 122 to an off-carriage ink reservoir such as one of the reservoirs 80–86 of the system of FIG. 1. FIG. 7 shows the valve structure 120 adjacent but not engaged with the port 116. FIG. 8 shows the valve structure 120 fully engaged with the port. As shown in FIG. 8, the structure 120 includes hollow needle 122 with a closed distal end, but with a plurality of openings 124 formed therein adjacent the end. A sliding valve collar 128 tightly fits about the needle, and is biased by a spring 126 to a valve closed position shown in FIG. 7. When the structure 120 is forced against the port 116, the collar is pressed up the length of the needle, allowing the needle tip to slide into the port opening 118, as shown in FIG. 8. In this position, ink can flow through the needle openings 124 between the reservoir 104 and the tube 130. Thus, with the cartridge 100 connected to an off-carriage reservoir via a valve structure such as 120, a fluid path is established between the print cartridge and the off-carriage reservoir. Ink can flow between the off-carriage ink reservoir to the cartridge reservoir 104. When the structure 120 is pulled away from the handle 108, the valve structure 120 automatically closes as a result of the spring 126 acting on the collar 128. The opening 118 will close as well due to the elasticity of the material 116, thereby providing a self-sealing refill port for the print cartridge.

FIGS. 6–8 illustrates a locking structure 172 for releasably locking the valve 120 into the refill arm 170 at socket 174. The structure 172 has locking surfaces 172B (FIG. 7) which engage against the outer housing of the valve body 120A. The structure is biased into the lock position by integral spring member 172A (FIGS. 7 and 8). By exerting force on structure 170 at point 170C (FIGS. 7 and 8) the spring is compressed, moving surface 172B out of engagement with the valve body, and permitting the valve to be pulled out of the refill arm socket. This releasing lock structure enables the valve and reservoir to be replaced quickly as a unit.

An ink printing system is described herein which includes an inkjet printer, a removable print cartridge having an ink reservoir, an initial fill port, and a refill valve, and an ink refill system for engaging the print cartridge's refill valve and transferring ink to the ink reservoir.

The print cartridge includes a handle which is used to facilitate insertion of the cartridge into, and removal of the cartridge from, a scanning carriage in the printer. The refill valve in the print cartridge is contained within the handle of the print cartridge. This location of the refill valve provides performance and manufacturing advantages.

The details of alignment coupler are clearly shown in FIGS. 9–20 as well as the related parts of the inlet port of the printhead reservoir and the outlet valve of the ink supply. The individual parts will be identified, and then their operation explained.

The coupler includes an outer shell 400, a curved wall 402 for engaging a matching curved frame 404 on the printhead, a straight wall 406 for engaging a matching straight frame 408 on the printhead, elongated corner guides 410 each having a raised land 412, side guides 414 each having twin raised lands 416, dual fingers 418 on opposite end walls for engaging small diameter slots on the inlet valve, and locking ledges 420 with concave recesses 422 on opposite side walls for engaging cutouts and cylindrical walls respectively on the printhead handle. The arms move back and forth to receive and then lock in the inlet valve, while the entire side walls expand to allow the locking ledges to receive and then lock in the handle of the printhead.

The printhead handle includes a septum 424 having a central dimple 426 for helping the needle valve of the ink supply to pass through normally closed path 428, as more fully described in connection with FIGS. 6–8. A metallic sleeve 430 provides the additional diameter needed on the ink supply valve to provide proper alignment of the valve interconnections.

Consistent with the goals of the invention in the preferred embodiment of FIGS. 9–20, the printhead and ink supply are permanently connected through the coupler 401 by the end user prior to operating the printer. Back pressure for proper operation is provided by locating the spring bag printhead reservoir adjacent to and in communication with the nozzle plate of the printhead.

It was a major design objective to leverage and take advantage of as much existing hardware as possible such as from the intermittent refilling embodiment of FIGS. 6–8. This objective was met by utilizing a printhead body with the rubber septum refill port and an off-carriage ink reservoir with valve.

Other important goals that have been achieved in the preferred embodiment of FIGS. 9–20 include the development of a simple connection scheme that an end user can use intuitively without any training. Also, allowing the ink supply valve to rotate freely with respect to the printhead body after the aforementioned connection has been made by the coupler. Further, maintaining a radial alignment of 0.95 mm between the tip of the needle on the ink supply valve and the center of the dimple on the septum of the inlet port for the printhead body. This is required to ensure that an air-tight fluid connection is made. Exceeding this alignment tolerance results in a defective fluid interconnection with the rubber of septum stretching over the tip of the needle like a finger cot on a finger. This alignment is facilitated by the structural features of the alignment coupler during the entire time period while the user is holding the valve and inserting it into the printhead body.

Prolonged insertion of the needle into the septum causes the septum to take a "compression set". If the needle is removed, the pen will ingest air, lose backpressure and begin leaking ink. This required that the valve interconnection be as tamper-proof and permanent as possible.

The alignment coupler snap fits over existing features on the handle area of the printhead body. It contains cylindrical features to provide alignment of the valve to the septum. It also has cantilevered fingers that "snap" into an existing groove on the ink supply valve. This provides retention of the ink supply valve in the inlet port of the printhead with the ink supply valve and matching inlet valve held in open position whether or not the printer is in active, dormant or overnight storage mode. The metal sleeve fits over the end of the ink supply valve and increases the diameter of the front part of the valve. A diameter of 14.6 mm was required to ensure that the alignment goal of plus or minus 0.95 mm was met. This could also have been achieved by changing the valve design to have one larger diameter. This would have made the new valve design incompatible with the existing manufacturing equipment. To maintain compatibility, a separate part is added to the ink supply valve.

Thus it will be appreciated by those skilled in the art that the invention does achieve the objectives of providing a high reliability fluid connection that is made by the end user and rakes advantage of related ink component features and manufacturing processes. However, such features did require modification since the printhead frame of the preferred embodiment does not by itself provide any features suitable for aligning the ink supply valve to the rubber septum in the inlet port within the required plus or minus 0.95 mm tolerance. To overcome this deficiency, the unique alignment coupler was developed, and is preferably installed on the printhead frame before the customer receives the unit, such as in the factory.

The alignment coupler could have easily been installed on the pen frame on the main manufacturing line. Unfortunately, the packaging equipment that places the printhead into its shipping sleeve could not handle a printhead with an alignment coupler already installed. In order to address this issue we created a printhead shipping sleeve that has a corner notch which allows access to the handle region of the printhead. The alignment coupler is attached while the printhead is in its shipping sleeve. The exposed coupler is protected by a kit box that holds both the printhead and the modular ink reservoir.

We claim as our invention:

1. A separate interconnect device which connects to an inkjet printhead inlet port in order to allow ink replenishment to an inkjet printhead comprising:

a body member forming an internal passage having side walls with a plurality of alignment guides for receiving an inlet valve from an off carriage ink supply when said inlet valve is inserted past said alignment guides in one end of said passage, said side walls shaped to position an opposite end of said passage adjacent the printhead inlet port;

first latching surfaces inside said passage for securely attaching said opposite end of the device to the printhead; and second latching surfaces inside said passage and integral with said body for securely attaching said one end of the device to the ink supply, said second latching surfaces actively locking said inlet valve to said body upon said insertion of said inlet valve.

2. The device of claim 1 wherein said first latching surfaces include a pair of ledges located on oppositely facing inside walls of said passage.

3. The device of claim 1 wherein said first latching surfaces are located on inside walls of said passage, and wherein said inside walls are expandable outwardly to engage the printhead.

4. The device of claim 3 wherein said first latching surfaces include a pair of ledges located on oppositely facing inside walls of said passage.

5. The device of claim 1 wherein said second latching surfaces include at least one movable arm which is expandable outwardly to engage an ink supply valve member.

6. The device of claim 1 wherein said alignment guides include corner guides located inside said passage.

7. The device of claim 1 wherein said passage and said first latching surfaces and said second latching surfaces are incorporated into a unitary component, with said first latching surfaces located on one pair of opposing inside walls of said passage and said second latching surfaces located on a different pair of opposing inside walls of said passage.

8. The device of claim 1 which further includes an ink delivery system comprising:

an off-carriage ink supply container for holding the off-carriage ink supply; and a supply of liquid ink in said container.

9. The device of claim 8 which further includes in said ink delivery system:

a print cartridge having the inkjet printhead and also having an ink reservoir both being incorporated as part of said print cartridge; and a supply of liquid ink in said ink reservoir.

10. A method of interconnecting an inkjet printhead with a separate ink supply comprising:

providing a separate unitary coupler with a first latching member constituting an expandable first wall portion to engage the printhead, and a second latching member constituting a movable arm integral with said unitary coupler to engage an outlet valve of the separate ink supply;

filling a reservoir in the printhead with a first supply of liquid ink;

initially attaching the coupler to the printhead by expanding the first wall portion to engage the printhead without opening an inlet port to the reservoir;

subsequently attaching the coupler to the ink supply by inserting the outlet valve into the coupler to cause locking engagement of the movable arm with the outlet valve of the ink supply; and establishing an open flow path allowing additional liquid ink from the separate ink supply to freely flow from the ink supply to the ink reservoir during operation of the printhead in order to replenish said first supply of liquid ink.

11. The new method of claim 10 including maintaining the coupler attached to both the printhead and the ink supply during operation of the printhead.

12. The method of claim 10 which includes initially attaching the coupler to the printhead securely to prevent dis-engagement of the coupler from the printhead.

13. The method of claim 10 which includes subsequently attaching the coupler to the ink supply securely to prevent dis-engagement of the coupler from the ink supply.

14. The method of claim 13 which includes initially attaching the coupler to the printhead securely to prevent dis-engagement of the coupler from the printhead.

15. The method of claim 10 which includes initially attaching the coupler to a handle of the printhead, the handle having an inlet port therein.

16. The method of claim 15 wherein the inlet port is in a normally closed position prior to the occurrence of said initially attaching.

17. The method of claim 10 which includes subsequently attaching the coupler to an on/off valve to the ink supply.

18. The method of claim 17 wherein the on/off valve is in a normally closed position prior to an occurrence of said subsequently attaching.

19. The method of claim 10 which further includes:

providing a container for holding the separate ink supply; and filling the container with a second supply of liquid ink.

* * * * *